US005283032A

United States Patent [19]

Wanner et al.

[11] Patent Number: 5,283,032

[45] Date of Patent: Feb. 1, 1994

[54] CONTROLLED THERMAL EXPANSION ALLOY AND ARTICLE MADE THEREFROM

[75] Inventors: Edward A. Wanner; Daniel A. DeAntonio, both of Leesport, Pa.

[73] Assignee: CRS Holdings, Inc., Wilmington, Del.

[21] Appl. No.: 946,403

[22] Filed: Sep. 16, 1992

Related U.S. Application Data

[63] Continuation-in-part of Ser. No. 571,170, Aug. 21, 1990, abandoned.

[51] Int. Cl.[5] ..... C22C 38/52

[52] U.S. Cl. ..... 420/586; 420/95

[58] Field of Search ..... 420/586, 95, 112; 148/442, 328

[56] References Cited

U.S. PATENT DOCUMENTS 4,066,447 1/1978 Smith, Jr. et al. ..... 420/586

*Primary Examiner*—Deborah Yee

*Attorney, Agent, or Firm*—Dann, Dorfman, Herrell and Skillman

[57] ABSTRACT

A precipitation strengthenable, nickel-cobalt-iron base alloy and articles made therefrom are disclosed. The alloy contains controlled amounts of silicon, nickel, cobalt, iron, chromium, niobium, titanium, and aluminum which are critically balanced to provide a unique combination of high strength, good ductility, and controlled thermal expansion, together with good thermal stability and good oxidation resistance up to about 1200° F. or higher.

14 Claims, No Drawings

CONTROLLED THERMAL EXPANSION ALLOY AND ARTICLE MADE THEREFROM

This application is a continuation-in-part of application Ser. No. 07/571,170, filed Aug. 21, 1990, now abandoned and assigned to the assignee of the present application.

BACKGROUND OF THE INVENTION

This invention relates to precipitation strengthenable, nickel-cobalt-iron base alloys and articles made therefrom that contain chromium, and in particular, to such an alloy and article in which the elements are balanced to provide a unique combination of controlled thermal expansion, elevated temperature oxidation resistance, strength, and ductility.

Precipitation strengthenable, controlled thermal expansion alloys have been used in apparatus in which close tolerances must be maintained at high operating temperatures, such as in jet aircraft engines and gas turbines, because they provide a combination of high strength and low thermal expansion properties that such uses demand. The high temperatures to which the known controlled thermal expansion alloys are exposed in use, e.g., up to 1000 F., are expected to become still higher, e.g., 1200 F. and above. The oxidation resistance and the stability of the gamma prime phase of the known controlled thermal expansion alloys become inadequate at such higher operating temperatures, and can result in shorter useful life of parts made from such alloys.

Protective coatings have been used to prevent catastrophic oxidation of the known controlled thermal expansion alloys at temperatures above 1000 F. A disadvantage of using protective coatings is that known coatings must be applied at high temperatures, e.g., 1550–1750 F., and exposure of the alloys to such temperatures limits the attainment of desired mechanical properties when the alloys are subsequently age hardened. The process of applying protective coatings often results in an undesirable amount of scrap material because of such defects as warpage or distortion of parts during the coating process.

Experience with the known precipitation strengthenable, controlled thermal expansion alloys has shown that they undergo a significant loss in strength when exposed for extended periods of time to the high temperatures and loads that are typical of commercial jet engines or gas turbines. This loss in strength is primarily attributable to transformation of the gamma prime strengthening phase to eta phase and/or epsilon phase, which are significantly less effective for providing the high strength desired in such alloys.

Accordingly, a need has arisen for a high-temperature alloy that provides low thermal expansion, high strength, good ductility, especially, good stress rupture ductility, and good oxidation resistance at temperatures up to about 1200° F. without requiring the application of a protective coating. Additionally, it is also desirable to provide good thermal stability in such an alloy. Here and throughout this application, the term "thermal stability" refers to the ability of the gamma prime strengthening phase to resist transformation at elevated temperatures and loads.

U.S. Pat. No. 4,066,447 ('447) relates to a nickel-iron base alloy that contains a small amount of chromium for the stated purpose of overcoming "certain difficulties of obtaining satisfactory notch strength, particularly 1200 F. notch-rupture strength, in high-strength low-expansion nickel-iron alloy product strengthened with gamma-prime precipitates . . . ". The broad composition of the alloy set forth in the '447 patent is as follows, in weight percent:

C 0–0.20
Mn 0–2
Si 0–1
P 0–0.015
S 0–0.015
Cr 1.7–8.3
Ni 30–57
Mo 0–1
Co 0–31
Ti 1–2
Al 0–1.5
Nb 1.5–5
Zr 0.10
B 0–0.03
Cu 0–1
W 0–1 and the balance is iron in an amount of at least 34 weight percent. The composition of the alloy is controlled to satisfy four relationships, A., B., C., and D. set forth in column 2, lines 52–61 of the patent. U.S. Pat. No. 4,200,459 ('459) relates to a nickel-iron base alloy which can contain up to 6.2% chromium. As characterized in the patent the alloy provides "controlled thermal expansion coefficient and inflection temperature and..-.high strength in [the] age-hardened condition and has [a] composition specially restricted to overcome detrimental sensitivity to stress-concentrating geometries and aid resistance to long-enduring stress in heated oxidizing atmospheres." The broad composition of the alloy set forth in the '459 patent is as follows, in weight percent:

C 0.03 max.
Mn 0–2
Si 0–0.5
P 0.015 max
S 0.015 max.
Cr 0–6.2
Ni 34–55.3
Mo 0–1
Co 0–25.2
Ti 1–2
Al 0.20 max.
Nb+½Ta 1.5–5.5
Zr 0–0.1
B 0–0.03
Cu 0–1
W 0–1
Mn+Cr 6.2 max.

and the balance is iron in the range of about 20–55%. The composition of the alloy is controlled to satisfy three relationships, A, B, and C set forth in column 2, lines 32–37 of the patent.

Although the '447 and '459 patents describe nickel-iron base alloys which contain chromium and may contain cobalt, and refer to low thermal expansion and high strength properties, they leave much to be desired in meeting modern day requirements for a good combination of low thermal expansion, high strength, good ductility, thermal stability, and good oxidation resistance at temperatures up to 1200 F. or above.

SUMMARY OF THE INVENTION

The problems associated with the known precipitation-strengthenable, controlled thermal expansion alloys, and articles made therefrom, under the anticipated higher operating temperature conditions are solved to a large degree in accordance with the broad element ranges of the nickel-cobalt-iron base alloy and articles made therefrom according to the present invention, the ranges being balanced to provide a unique combination of elevated temperature oxidation resistance, controlled thermal expansion, high strength, good ductility, and thermal stability. Best results are provided in accordance with the preferred ranges of the elements, which together with the broad and intermediate ranges of the present alloy are summarized in Table I below, containing in weight percent, about:

TABLE I

| | Broad | Intermediate | Preferred |
|---|---|---|---|
| C | 0.2 max. | 0.1 max. | 0.05 max. |
| Mn | 1 max. | 0.5 max. | 0.2 max. |
| Si | 0.1–0.8 | 0.15–0.6 | 0.2–0.55 |
| P | 0.015 max. | 0.010 max. | 0.005 max. |
| S | 0.010 max. | 0.010 max. | 0.005 max. |
| Cr | 2.0–10 | 2.5–8.0 | 3.0–7.5 |
| Ni | 15–29 | 18–28 | 20–27 |
| Mo | 3 max. | 0.5 max. | 0.2 max. |
| Co | 24–46 | 26–40 | 27–34 |
| Ti | 0.3–2 | 0.4–1.8 | 0.5–1.5 |
| Al | 1 max. | 0.1–0.9 | 0.2–0.8 |
| Nb | 3–7 | 3.5–6.5 | 4.0–6.0 |
| V | 0.5 max. | 0.5 max. | 0.2 max. |
| Zr | 0.1 max. | 0.1 max. | 0.05 max. |
| B | 0.02 max. | 0.002–0.02 | 0.003–0.01 |
| Cu | 0.5 max. | 0.5 max. | 0.2 max. |
| W | 0.5 max. | 0.5 max. | 0.2 max. |

and the balance in each case is essentially iron. Within their ranges the elements are balanced in accordance with the following relationships:

$$\frac{\%\,Ni - 1.4(\%\,Nb) - 4.8(\%\,Al) - 2.7(\%\,Ti)}{\%\,Co - 0.3(\%\,Nb) - 1.1(\%\,Al) - 0.6(\%\,Ti)} \quad \text{(Rel. 1)}$$

$$\frac{[\%\,Ni + \%\,Co - 1.7(\%\,Nb) - 5.9(\%\,Al) - 3.3(\%\,Ti)] \times 100}{\%\,Ni + \%\,Co + \%\,Cr + \%\,Fe - 1.81(\%\,Nb) - 6.28(\%\,Al) - 3.52(\%\,Ti)} \quad \text{(Rel. 2)}$$

such that Rel. 1 is at least about 0.3, but not greater than about 1.3, and Rel. 2 is at least about 47, but not greater than about 53. The combined amount of niobium, titanium, and aluminum is about 3–7 atomic percent of the alloy, and niobium, titanium, and aluminum are proportioned on a weight percent basis such that the ratio %Nb:%Ti =3:1 to 8:1 and the ratio %Ti:%Al >1:1. For the alloy as set forth in Tables I and II, hardener content in weight percent can be converted to atomic percent hardener with reasonable accuracy using the following simplified relationship: atomic percent hardener $\cong 0.62(\%Nb)+1.20(\%Ti)+2.13(\%Al)$. Molybdenum and chromium are proportioned such that the ratio %Mo:%Cr $\leqq$1:2 when more than about 0.5% molybdenum is present. The sum $\%Mn+\%V+\%Cu+\%W \leqq 2$ and, when molybdenum is restricted to about 0.5% max., the sum $\%Mn+\%Mo+\%V+\%Cu+\%W \leqq 2$. Furthermore, up to about 0.01% max. each of calcium, magnesium, and/or cerium can be present as residuals from deoxidizing aid/or desulfurizing additions.

The foregoing tabulation is provided as a convenient summary and is not intended to restrict the lower and upper values of the ranges of the individual elements of the alloy of this invention for use solely in combination with each other, or to restrict the broad, intermediate or preferred ranges of the elements for use solely in combination with each other. Thus, one or more of the broad, intermediate, and preferred ranges can be used with one or more of the other ranges for the remaining elements. In addition, a broad, intermediate, or preferred minimum or maximum for an element can be used with the maximum or minimum for that element from one of the remaining ranges.

Here and throughout this application percent (%) means percent by weight, unless otherwise indicated. Furthermore, it is intended by reference to niobium to include the usual amount of tantalum found in commercially available charge materials used in making alloying additions of niobium to commercial alloys.

DETAILED DESCRIPTION

In the alloy according to the present invention, nickel, cobalt, and iron act together to provide an austenitic matrix structure, which resists transformation to martensite down to very low temperatures. Nickel and cobalt both contribute to the low coefficient of thermal expansion as well as the elevated inflection temperature of the alloy. Here and throughout this application the terms "coefficient of thermal expansion" and "thermal expansion coefficient" are defined as the mean coefficient of linear thermal expansion over a specified temperature range, usually from room temperature up to an elevated temperature. Nickel, cobalt, and iron also react with one or more of the elements niobium, titanium, aluminum, and silicon to form intermetallic phases brought out as intragranular and/or intergranular precipitates primarily by an age hardening heat treatment and also, though to a lesser extent, during cooling after solution treatment, as those heat treatments are discussed more fully hereinbelow. Accordingly, at least about 15%, better yet at least about 18%, and preferably at least about 20% nickel is present; and at least about 24%, better yet at least about 26%, and preferably at least about 27% cobalt is present in this alloy.

The benefits realized from nickel and cobalt diminish in value at higher levels of those elements so that the added cost thereof is not warranted. Furthermore, too much nickel and/or cobalt in substitution for some of the iron causes the coefficient of thermal expansion of the alloy to increase. Accordingly, nickel is restricted to not more than about 29%, better yet to not more than about 28%, and preferably to not more than about 27%. Cobalt is restricted to not more than about 46%, better yet to not more than about 40% and preferably to not more than about 34%.

Chromium benefits the corrosion resistance and the elevated temperature oxidation resistance of the alloy and at least about 2.0%, better yet at least about 2.5%, and preferably at least about 3.0% chromium is present in the alloy. However, chromium has an increasingly adverse effect on the low thermal expansion property of this alloy because increasing amounts of chromium result in lowering of the inflection temperature and increases in the coefficient of thermal expansion up to the inflection temperature. Accordingly, not more than about 10%, better yet not more than about 8.0%, and preferably not more than about 7.5% chromium is present in the alloy. For best results the alloy contains about 4.0–7.5% chromium.

Niobium, titanium, and, when present, aluminum contribute primarily to the high strength provided by the alloy. Portions of the niobium, titanium, and aluminum react with some of the nickel, iron, and/or cobalt to form strengthening phases during age hardening heat treatment of the alloy. Depending on the particular composition, some of the phases which may precipitate in the alloy are the known gamma prime, gamma double-prime, eta, epsilon, and/or delta phases. The elements niobium, titanium, and aluminum are balanced to provide a gamma prime phase which resists transformation to epsilon or eta phase when the alloy is exposed to high temperatures and loads because gamma prime is a more effective strengthener, particularly under elevated temperature conditions than either of epsilon or eta phase.

Additionally, a globular, intermetallic phase, containing nickel, cobalt, niobium, and silicon, precipitates intra- and/or intergranularly in the alloy during hot or warm working operations. The Ni-Co-Nb-Si phase has a higher solvus temperature than those corresponding to the other intermetallic phases described above. Due to its relatively high solvus temperature, a significant amount of the Ni-Co-Nb-Si phase remains out of solution when the alloy is heated up to about 2050 F.

In order to ensure the precipitation of a sufficient quantity of the strengthening phases to provide the combination of high strength and good stress rupture ductility that are characteristic of this alloy, at least about 3% or 3.0%, better yet at least about 3.5%, and preferably at least about 4.0% niobium is present in this alloy. At least about 0.3%, better yet at least about 0.4%, and preferably at least about 0.5%, titanium is present in the alloy. Up to about 1% aluminum can be present in the alloy and preferably, at least about 0.1%, or better yet at least about 0.2% aluminum is present in this alloy because it contributes to the stability of the gamma prime phase against transformation to eta or epsilon phase, when the alloy is exposed to high temperatures and loads. The good thermal stability of the gamma prime phase benefits the high temperature strength and creep resistance of this alloy. For best results the alloy contains at least about 0.3% aluminum.

Excessive amounts of niobium, titanium, and/or aluminum adversely affect the low thermal expansion coefficient and the high inflection temperature which are characteristic of this alloy. Additionally, too much niobium results in formation of an undesirable amount of a Laves phase, i.e., $(Fe, Ni, Co)_2(Nb, Si)$, during solidification. Niobium is restricted, therefore, to not more than about 7%, better yet to not more than about 6.5%, and preferably to not more than about 6.0% in this alloy. Too much aluminum and/or titanium in this alloy adversely affect the tensile ductility and stress rupture ductility of the alloy, in addition to their adverse effect on the thermal expansion properties. Accordingly, not more than about 1%, better yet not more than about 0.9%, and preferably not more than about 0.8% aluminum is present in the alloy. For best results, the alloy contains not more than about 0.7% aluminum. Too much titanium also adversely affects the oxidation resistance of the alloy and so not more than about 2%, better yet not more than about 1.8%, and preferably not more than about 1.5% titanium is present in this alloy.

Niobium, titanium, and aluminum are controlled within their ranges to provide the unique combination of strength, ductility, thermal stability, low thermal expansion coefficient, and oxidation resistance that are characteristic of this alloy. In this regard, the combined amount of Nb, Ti, and Al present in the alloy is about 3–7 atomic percent and preferably, about 4–6 atomic percent. In addition, the weight percents of Nb, Ti, and Al are proportioned such that the ratio %Nb:%Ti is 3:1 to 8:1, better yet 4:1 to 8:1, and preferably 4:1 to 7:1; and the ratio %Ti:%Al is at least 1:1 and preferably 1:1 to 4:1.

At least about 0.1% silicon is present in this alloy because it contributes to the rupture life and combination smooth-notch rupture ductility of the alloy by reacting with nickel, cobalt, and niobium as described above to form the Ni-Co-Nb-Si phase. Silicon also benefits the oxidation resistance of this alloy. Preferably, at least about 0.15%, and better yet at least about 0.2% silicon is present. Too much silicon adversely affects the tensile and yield strengths of the alloy and promotes the formation of undesirable amounts of a Laves phase, i.e., $(Fe, Ni, Co)_2:(Nb, Si)$, during solidification. Therefore, not more than about 0.8%, better yet not more than about 0.6%, and preferably not more than about 0.55% silicon is present in this alloy. For best results, the alloy contains not more than about 0.45% silicon.

Other elements may be present in the alloy as optional additions. For example, at least a small but effective amount of boron can be present in this alloy and preferably at least about 0.002%, or better yet at least about 0.003%, boron is present. When present, the small amount of boron is believed to prevent the precipitation of undesirable phases in the grain boundaries and thus to improve stress rupture life and ductility. Boron is limited to not more than 0.02%, however, and preferably to not more than about 0.01% in the present alloy.

This alloy can contain up to about 0.1%, preferably up to about 0.05% zirconium for the same reasons as for including boron.

For enhanced pitting resistance in mildly corrosive atmospheric environments such as high humidity climates or saline environments, up to about 3% molybdenum can be present in this alloy in direct substitution for some of the chromium, provided that the ratio of molybdenum to chromium does not exceed 1:2 on a weight percent basis. Because molybdenum adversely affects the low thermal expansion coefficient of this alloy, it is preferably restricted to about 0.5% max. and for best results to about 0.2% max.

Other elements can be present in this alloy in residual amounts resulting from the melting practice utilized. For example, about 1.0% max., better yet about 0.5% max., or preferably about 0.2% max. manganese can be present. Up to about 0.5% max., preferably up to about 0.2% max., each of vanadium, copper, and/or tungsten can be present in the alloy. The sum %Mn+%V+%Cu+%W or, when molybdenum is restricted to about 0.5% max., the sum Mn+%Mo+%V+%Cu+%W is not more than about 2% max., preferably not more than about 1% max., because of the adverse effect of those elements on the alloy's inflection temperature and coefficient of thermal expansion.

Up to about 0.01% max., preferably up to about 0.005% max., each of calcium, magnesium, and/or cerium can be present as residuals from deoxidizing and/or desulfurizing additions and also to benefit the desired mechanical properties, such as elevated temperature tensile ductility and stress rupture ductility.

The balance of the alloy is iron except for the usual impurities found in commercial grades of alloys for the same or similar service or use. However, the levels of such impurity elements must be controlled so as not to adversely affect the desired properties of the present alloy. In this regard carbon is restricted to about 0.2% max., better yet to about 0.1% max., and preferably to about 0.05% max. Phosphorus is limited to not more than about 0.015%, better yet to about 0.010% max., and preferably to about 0.005% max.; and sulfur is limited to not more than about 0.010% max., preferably to not more than about 0.005% max.

An advantage of the present alloy is that nickel, cobalt, chromium, and iron are controlled to provide a highly desirable combination of oxidation resistance and controlled thermal expansion over a wide temperature range, e.g., from room temperature up to about 1200 F. As previously described, the alloy has an essentially austenitic matrix structure. Recognizing that the precipitation reactions that form the strengthening phases during suitable solution and age hardening heat treatments also reduce the nickel and cobalt contents of the matrix, the elements are balanced in accordance with the following relationships to provide the desired combination of oxidation resistance and low thermal expansion coefficient after such heat treatments:

$$\frac{\%\ Ni - 1.4(\%\ Nb) - 4.8(\%\ Al) - 2.7(\%\ Ti)}{\%\ Co - 0.3(\%\ Nb) - 1.1(\%\ Al) - 0.6(\%\ Ti)} \quad \text{(Rel. 1)}$$

$$\frac{[\%\ Ni + \%\ Co - 1.7(\%\ Nb) - 5.9(\%\ Al) - 3.3(\%\ Ti)] \times 100}{\%\ Ni + \%\ Co + \%\ Cr + \%\ Fe - 1.81(\%\ Nb) - 6.28(\%\ Al) - 3.52(\%\ Ti)} \quad \text{(Rel. 2)}$$

The elements Ni, Co, Fe, Cr, Nb, Al, and Ti are controlled in accordance with the foregoing relationships such that Rel. 1 is about 0.3–1. 3, better yet about 0.3–1. 2, preferably about 0.4–1.0, and for best results about 0.4–0.7; and Rel. 2 is about 47–53, better yet about 4714 52, and preferably about 48–52.

The alloy of the present invention is readily melted using vacuum melting techniques and cast into various forms. For best results when additional refining is desired, a multiple melting practice is preferred. For example, the preferred commercial practice is to melt a heat in a vacuum induction furnace (VIM) and cast the heat in the form of an electrode. The electrode is remelted preferably in a vacuum arc furnace (VAR), and then recast into an ingot. Electroslag remelting (ESR) also can provide satisfactory refining. Ingots of this alloy are usually homogenized to minimize any compositional gradients and to reduce the amount of or remove any Laves phase that may be present. When homogenization is performed for this alloy it is preferably carried out between 2050–2250 F. for 24 hours or more so as not to create excessive ingot porosity.

The alloy can be hot worked from about 2200° F. to its recrystallization temperature, but is preferably hot worked from about 2100–1900 F. Warm working of the alloy can be performed to well below the recrystallization temperature, for example to about 1700 F. Solution treatment of the alloy is preferably carried out after hot or warm working. The alloy is solution treated preferably at about 1800–2100 F. for a time commensurate with the size of the article being heat treated. In this regard, solution treatment is carried out for about one hour at temperature per inch of metal thickness, but not less than ¼ hour. Solution treatment of the alloy is followed by cooling the article preferably in air. The alloy can also be cooled from the solution temperature at a faster cooling rate such as by water quenching, when desired.

Precipitation or age hardening of the alloy is preferably conducted by heating the alloy at about 1250–1550 F. for at least about 4 hours. Thereafter, the alloy is cooled in a controlled manner, as by furnace cooling at a rate preferably not greater than about 100 F.°/h, to a temperature in the range 1000–1250 F. and held at such temperature for at least about 4 hours.

EXAMPLE I

Example Heats 1–10 of the alloy according to the present invention were prepared having the compositions in weight percent shown in Table II. Heats 1–10 were cast from 17 lb. VIM heats as 2¾ in square ingots. All heats were deoxidized with a 0.05% calcium addition. Heats 1–4 differ significantly with respect to the hardener elements titanium, aluminum, and niobium, Heats 5–8 with respect to chromium, and Heats 9 and 10 with respect to silicon. All of the ingots were homogenized and then press forged from 2050 F. to 1½ in square, reheated to 1950 F., press forged to 1 in square, reheated to 1950 F., and then press forged to ¾ in square bars.

Blanks for tensile specimens, combination smooth-/notch stress rupture specimens, dilatometer specimens, corrosion testing specimens, and oxidation testing specimens were cut from each of the forged bars. All blanks were cut with a longitudinal orientation. The blanks for Heats 1 and 9 were heat treated by solution treating at 1900 F. for 1 h then cooling in air, followed by aging at 1325 F. for 8 h, furnace cooled at the rate of 100 F.°/h to 1150 F., holding at that temperature for 8 h and then cooling in air. The blanks for Heats 2–8 and 10 were heat treated by solution treating at 2000 F. and then aged similarly to Heats 1 and 9. Solution treatments were selected to obtain similar grain size in all test specimens.

TABLE II

| | Ht. 1 | Ht. 2 | Ht. 3 | Ht. 4 | Ht. 5 | Ht. 6 | Ht. 7 | Ht. 8 | Ht. 9 | Ht. 10 |
|---|---|---|---|---|---|---|---|---|---|---|
| C | 0.015 | 0.013 | 0.012 | 0.013 | 0.013 | 0.013 | 0.013 | 0.015 | 0.016 | 0.015 |
| Mn | <0.01 | <0.01 | <0.01 | <0.01 | <0.01 | <0.01 | <0.01 | <0.01 | <0.01 | <0.01 |
| Si | 0.35 | 0.35 | 0.35 | 0.37 | 0.36 | 0.36 | 0.36 | 0.35 | 0.08 | 0.50 |
| P | <0.003 | <0.003 | <0.003 | <0.003 | <0.003 | <0.003 | <0.003 | <0.003 | <0.003 | <0.003 |
| S | 0.001 | 0.001 | 0.001 | 0.001 | <0.001 | <0.001 | 0.001 | <0.001 | <0.001 | <0.001 |
| Cr | 5.55 | 5.50 | 5.44 | 5.35 | 3.56 | 4.64 | 6.13 | 7.16 | 5.45 | 5.46 |
| Ni | 24.02 | 24.81 | 25.57 | 26.25 | 25.84 | 25.67 | 25.40 | 25.18 | 25.59 | 25.49 |
| Mo | 0.01 | 0.01 | 0.01 | 0.01 | 0.01 | 0.01 | 0.01 | 0.01 | 0.01 | 0.01 |
| Co | 28.11 | 27.89 | 27.51 | 27.06 | 28.18 | 27.81 | 27.28 | 26.89 | 27.58 | 27.46 |
| Ti | 0.67 | 0.75 | 0.83 | 0.93 | 0.83 | 0.83 | 0.83 | 0.83 | 0.83 | 0.84 |
| Al | 0.35 | 0.40 | 0.44 | 0.49 | 0.44 | 0.44 | 0.44 | 0.45 | 0.45 | 0.44 |
| Nb | 3.79 | 4.27 | 4.75 | 5.25 | 4.79 | 4.74 | 4.77 | 4.76 | 4.75 | 4.79 |
| B | 0.007 | 0.005 | 0.006 | 0.005 | 0.005 | 0.005 | 0.005 | 0.005 | 0.005 | 0.005 |

TABLE II-continued

| | Ht. 1 | Ht. 2 | Ht. 3 | Ht. 4 | Ht. 5 | Ht. 6 | Ht. 7 | Ht. 8 | Ht. 9 | Ht. 10 |
|---|---|---|---|---|---|---|---|---|---|---|
| V | <0.01 | <0.01 | 0.01 | 0.01 | <0.01 | <0.01 | <0.01 | <0.01 | 0.03 | <0.01 |
| Fe | Bal. | Bal. | Bal. | Bal. | Bal. | Bal. | Bal. | Bal. | Bal. | Bal. |
| Rel. 1 | 0.58 | 0.58 | 0.58 | 0.58 | 0.57 | 0.58 | 0.58 | 0.58 | 0.58 | 0.58 |
| Rel. 2 | 49.67 | 49.95 | 50.03 | 49.85 | 51.20 | 50.53 | 49.51 | 48.72 | 50.11 | 49.83 |
| At. % (Nb + Ti + Al)* | 3.9 | 4.4 | 4.9 | 5.4 | 4.9 | 4.9 | 4.9 | 4.9 | 4.9 | 4.9 |

Bal. includes usual impurities, e.g., <0.01% Cu, <0.01% W, <15 ppm Ca, <20 ppm O or N.
*Calculated as 0.62 (% Nb) + 1.20 (% Ti) + 2.13 (% Al).

After being heat treated, the blanks of each heat were finish machined as follows, unless otherwise indicated: duplicate standard subsize tensile test specimens with 0.252 in gage diameter in accordance with ASTM Spec. E8, A370; duplicate standard combination smooth-/notch stress rupture test specimens in accordance with ASTM Spec. E292 with 0.178 in gage diameter and 0.178 in notch diameter to provide $K_t=3.8$, prepared by low stress grinding; dilatometer specimens 2 in long by 0.2 in diameter for thermal expansion testing; conical, corrosion test specimens having a 60° apex angle; and ½ in diameter × ½ in long, cylindrical, oxidation test specimens. The conical surfaces of the corrosion test specimens were polished and the ends of the oxidation test specimens were ground parallel and flat.

The results of room temperature tensile tests are tabulated in Table III. The tensile data presented in Table III include the 0.2% offset yield strength (Y.S.) and ultimate tensile strength (U.T.S.) in ksi, as well as the percent elongation (% El.) and the percent reduction in cross-sectional area (%R.A.) for each of the duplicate tensile test specimens.

TABLE III

| Ht. No. | Y.S. | U.T.S. | % El. | % R.A. |
|---|---|---|---|---|
| 1 | 109.7 | 170.9 | 21.8 | 42.0 |
| | 102.8 | 161.8 | 23.3 | 37.8 |
| 2 | 114.2 | 167.9 | 20.2 | 49.0 |
| | 111.7 | 165.3 | 20.9 | 52.4 |
| 3 | 141.3 | 193.2 | 12.8 | 23.8 |
| | 141.8 | 192.6 | 13.3 | 29.3 |
| 4 | 151.8 | 199.8 | 9.0 | 18.2 |
| | 147.8 | 199.0 | 8.8 | 18.2 |
| 5 | 141.3 | 190.1 | 13.7 | 31.9 |
| | 150.5 | 194.7 | 12.0 | 27.4 |
| 6 | 134.8 | 184.8 | 14.0 | 32.7 |
| | 142.8 | 192.4 | 15.0 | 38.3 |
| 7 | 142.3 | 193.2 | 10.0 | 21.0 |
| | 140.9 | 192.1 | 13.5 | 34.0 |
| 8 | 137.3 | 191.2 | 15.8 | 31.9 |
| | 133.9 | 186.6 | 12.0 | 32.1 |
| 9 | 148.3 | 199.0 | 13.9 | 35.8 |
| | 152.0 | 204.0 | 13.8 | 29.3 |
| 10 | 126.8 | 178.6 | 13.4 | 28.2 |
| | 130.8 | 182.4 | 12.8 | 29.3 |

Stress rupture testing was carried out on the combination smooth/notch specimens by applying a constant load at 1200 F. to generate an initial stress of 74 ksi. The results of the stress rupture testing are presented in Table IV and include the time to failure in hours (Rupt. Life), as well as the percent elongation (% El.) for each of the duplicate test specimens.

TABLE IV

| Ht. No. | Rupt. Life | % El. | % R.A. |
|---|---|---|---|
| 1 | 404.5 | 20.8 | 41.8 |
| | 397.9 | 17.4 | 39.7 |
| 2 | 228.1 | 15.4 | 19.2 |
| | 427.0 | 27.1 | 59.0 |
| 3 | 654.0 | 21.4 | 39.0 |
| | 782.9 | 22.4 | 50.5 |

TABLE IV-continued

| Ht. No. | Rupt. Life | % El. | % R.A. |
|---|---|---|---|
| 4 | 858.9 | 25.0 | 37.3 |
| | 957.9 | 27.5 | 60.6 |
| 5 | 669.6 | 9.0 | 16.0 |
| | 593.3 | NOTCH BREAK | |
| 6 | 658.9 | 6.5 | 19.2 |
| | 620.7 | 21.8 | 55.4 |
| 7 | 817.8 | 28.1 | 46.6 |
| | * | * | * |
| 8 | 704.1 | 26.2 | 61.8 |
| | 686.3 | 36.0 | 55.4 |
| 9 | 1381.6 | 13.2 | 22.1 |
| | 1391.0 | 17.0 | 41.8 |
| 10 | 572.8 | 21.2 | 57.0 |
| | 491.9 | 22.7 | 56.2 |

*Specimen was damaged before it could be tested.

The coefficient of thermal expansion and inflection temperature were determined for each example from expansion measurements taken on a differential dilatometer while increasing the temperature of each specimen from room temperature up to the temperature shown in each column of Table V with measurements taken about every 15F.°. The results of the expansion testing are reported as the mean coefficient of linear thermal expansion from room temperature up to the indicated temperature. The inflection temperatures were determined by the tangent intersection method. The results of expansion testing for the example heats are shown in Table V, including the coefficient of thermal expansion and the inflection temperature (Infl. Temp.) in degrees Fahrenheit (F).

TABLE V

| | Mean Coeff. of Linear Thermal Expansion (× 10−6/F.°) from Room Temperature to | | | | | |
|---|---|---|---|---|---|---|
| Ht. No. | 400 F. | 600 F. | 800 F. | 1000 F. | 1200 F. | Infl. Temp. |
| 1 | 4.13 | 4.44 | 5.38 | 6.15 | 6.80 | 547 F. |
| 2 | 4.37 | 4.50 | 5.40 | 6.15 | 6.97 | 605 F. |
| 3 | 4.29 | 4.56 | 5.42 | 6.14 | 6.75 | 610 F. |
| 4 | 4.67 | 4.82 | 5.60 | 6.27 | 6.85 | 600 F. |
| 5 | 4.54 | 4.52 | 4.80 | 5.53 | 6.17 | 724 F. |
| 6 | 4.35 | 4.44 | 5.13 | 5.88 | 6.52 | 647 F. |
| 7 | 4.46 | 4.93 | 5.78 | 6.52 | 6.98 | 542 F. |
| 8 | 4.46 | 5.40 | 6.25 | 6.85 | 7.37 | 470 F. |
| 9 | 4.21 | 4.43 | 5.30 | 6.02 | 6.64 | 605 F. |
| 10 | 4.43 | 4.69 | 5.54 | 6.24 | 6.84 | 601 F. |

The corrosion test specimens were tested in a salt spray containing 5% NaCl at 95 F. (35C.) in accordance with ASTM Standard Method B117. The results of the salt spray tests for Heats 1-10 are shown in Table VI. The data include the time to first appearance of rust (lst Rust) in hours (h) and a rating of the degree of corrosion after 200 h (200 h Rating). The rating system used is as follows: 1=no rusting; 2=1 to 3 rust spots; 3=approx. 5% of surface rusted; 4 = 5 to 10% of surface rusted; 5 = 10 to 20% of surface rusted; 6=20 to 40% of surface rusted; 7=40 to 60% of surface rusted; 8=60 to 80% of surface rusted; 9=more than 80% of surface rusted. Only the conical surface of each specimen was evaluated for rust.

TABLE VI

| Ht. No. | 1st Rust | 200 h Rating |
|---|---|---|
| 1 | 4 h | 2 |
| 2 | 2 h | 3 |
| 3 | 2 h | 3 |
| 4 | 1 h | 4 |
| 5 | 1 h | 4 |
| 6 | 1 h | 4 |
| 7 | 5-24 h* | 2 |
| 8 | 1 h | 2 |
| 9 | 1 h | 4 |
| 10 | 1 h | 2 |

*No rust observed at 5 h, next reading taken at 24 h.

The oxidation test specimens for Heats 5-10 were cleaned, degreased, and then placed in an oven at 200 F., to drive off moisture. The dried specimens were each weighed, placed in a glazed porcelain crucible, and then each crucible was weighed. The crucibles were then placed in a static air furnace and heated for 100 h at a furnace temperature of 1250 F. When the crucibles were removed from the furnace they were cooled to room temperature. The test specimens were reweighed with and without the crucibles.

The results of the static air oxidation testing are shown in Table VII including the oxidation weight gain (Wt. Gain) in milligrams per square decimeter ($mg/dm^2$). Heats 1-4 were not tested for oxidation resistance because the differences in hardener content among them were not believed to result in a significant difference in oxidation resistance as compared to the differences in chromium of Heats 5-8 and the differences in silicon of Heats 9 and 10.

TABLE VII

| Ht. No. | Wt. Gain |
|---|---|
| 5 | 88.08 |
| 6 | 59.36 |
| 7 | 44.59 |
| 8 | 9.11 |
| 9 | 41.58 |
| 10 | 49.87 |

The data presented in Tables III-VII demonstrate the unique combination of properties provided by the alloy according to this invention, including good tensile strength and ductility, good stress rupture strength and ductility, good thermal expansion coefficient, and good corrosion and elevated temperature oxidation resistance.

EXAMPLE II

Example Heat 11 of the alloy according to the present invention was prepared having the composition in weight percent shown in Table VIII.

TABLE VIII

| | Ht. 11 |
|---|---|
| C | 0.014 |
| Mn | 0.02 |
| Si | 0.36 |
| P | 0.004 |
| S | 0.0010 |
| Cr | 5.50 |
| Ni | 24.52 |
| Mo | 0.01 |
| Co | 28.78 |
| Ti | 0.86 |

TABLE VIII-continued

| | Ht. 11 |
|---|---|
| Al | 0.48 |
| Nb | 4.80 |
| B | 0.0041 |
| V | 0.05 |
| Fe | Bal. |
| Rel. 1 | 0.50 |
| Rel. 2 | 50.19 |
| At. % (Nb + Ti + Al)* | 5.03 |

Bal. includes usual impurities, e.g., 0.01% Cu, <0.02% W
*Calculated as 0.62 (% Nb) + 1.20 (% Ti) + 2.13 (% Al)

Heat 11 was vacuum induction melted (VIM) and refined by vacuum arc remelting (VAR) to form a 20 in diameter, production-size ingot. The ingot was homogenized, rotary forged from 2000 F. to 8 in round billet, and then cooled in air. A 3in thick disc was cut from the 8 in billet and sectioned to form a 3 in square transverse segment. The transverse segment was then press forged from 1900 F. to 1½ in square, reheated to 1900 F., press forged to 1½ in by ¾ in flat, and then cooled in air.

Blanks for tensile specimens were cut from the forged flat of Heat 11. The specimen blanks of Heat 11 were heat treated by solution treating at 2000 F. for 1 h then cooling in air, followed by aging at 1325 F. for 8h, furnace cooling at the rate of 100F.°/h to 1150 F., holding at 1150 F. for 8 h, and then cooling in air. After being heat treated the specimen blanks were finish machined to standard subsize tensile/creep specimens with a 0.252 in gage diameter in accordance with ASTM Spec. E8, A370.

The tensile/creep specimens were divided into five groups for testing. Group I specimens were tested in the solution treated and aged condition. The specimens of Groups II, III, IV, and V were exposed to elevated temperature and/or stress conditions before testing. In particular, the specimens of Groups II and III were exposed at 1250 F. under static, i.e., no applied stress, conditions in air, in a resistance furnace for about 300 h. The specimens of Groups IV and V were similarly exposed, but under stress conditions designed to generate 0.3% plastic creep strain in the specimen in about 300 h. Before testing, the Group II and Group IV specimens were machined to remove the surface oxide layer generated during their respective exposures.

Shown in Table IX are the loading histories for the specimens of Groups IV and V during their respective exposures, including the time of exposure (Time) in hours and the amount of applied stress (Applied Stress) in ksi.

TABLE IX

| Exposure Group | Time (h) | Applied Stress (ksi) |
|---|---|---|
| IV | 0-169.7 | 60.0 |
| | 169.7-210.6 | 62.5 |
| V | 0-120 | 50.0 |
| | 120-171 | 55.0 |
| | 171-263 | 60.0 |
| | 263-310 | 62.5 |

[1]Test terminated when specimen attained 0.3% creep.

The results of room temperature tensile tests of the specimens from Groups I-V are tabluated in Table X. The tensile data presented in Table X include the 0.2% offest yield strength (0.2% Y.S.) and ultimate tensile strength (U.T.S.) in ksi, as well as the percent elongation (% El.) and the percent reduction in cross-sectional area (%R.A.) for each of the test specimens. Also shown in Table X for the specimens of Groups II–V are the changes in yield strength (ΔY.S.) and tensile strength (ΔU.T.S.) in ksi, the changes in percent elongation (Δ%El.), and the changes in reduction in cross-sectional area (Δ%R.A.) relative to the respective properties of the solution treated and aged (Group I) specimens.

TABLE X

| Exposure Group | 0.2% Y.S. | Δ Y.S. | U.T.S. | Δ U.T.S. | % El. | Δ % El. | % R.A. | Δ % R.A. |
|---|---|---|---|---|---|---|---|---|
| I | 127.0 | — | 178.0 | — | 16.0 | — | 32.0 | — |
| II | 123.9 | −3.1 | 171.8 | −6.2 | 15.9 | −0.1 | 28.9 | −3.1 |
| III | 123.4 | −3.6 | 171.4 | −6.6 | 17.0 | +1.0 | 34.8 | +2.8 |
| IV | 120.0 | −7 | 169.5 | −8.5 | 16.0 | 0 | 34.7 | +2.7 |
| V | 118.8 | −8.2 | 165.3 | −12.7 | 20.0 | +4.0 | 38.6 | +6.6 |

The data of Table X shows the good thermal stability of the alloy according to the present invention. The good thermal stability of Heat 11 is demonstrated by the fact that it retained nearly 94% of its initial yield strength and nearly 93% of its initial tensile strength after the most severe exposure conditions (Group V). Furthermore, the Heat 11 specimens retained a significant proportion of their initial ductility, as manifested by their %El. and %R.A. In fact, the Group III and Group V specimens of Heat 11 showed a small, unexpected improvement in ductility. Moreover, the fact that the specimens with the oxide layer intact (Groups III and V) show similar losses in strength to the specimens with the oxide layer removed (Groups II and IV), demonstrates that the metallurgical changes in the surface that result from surface oxidation are relatively small.

CONCLUSION

The alloy of the present invention has utility in a wide variety of uses where high strength, low thermal expansion, and good corrosion and/or oxidation resistance are required. For example, the alloy is suitable for use in jet aircraft engine and gas turbine parts, including, but not limited to, spacers, engine casings, diffusers, ducting, discs, rings, fasteners and other structural engine parts. In addition, this alloy is suitable for use in tools for the extrusion and/or die casting of such materials as aluminum and aluminum alloys, including such articles as extrusion die blocks, extrusion dummy blocks, extrusion liners, and die casting dies and die components. This alloy is also useful in components for the manufacture of parts from thermosetting composite materials where a low thermal expansion coefficient is desirable to prevent heat checking or to avoid expansion mismatch with the part being fabricated. The alloy is also well suited for the fabrication of parts requiring high temperature forming techniques such as brazing or welding. The present alloy is, of course, also suitable for use in a variety of product forms such as castings, billets, bars, sheet, strip, rod, wire, or powder.

It is apparent from the foregoing description and the accompanying examples, that the alloy according to the present invention provides a unique combination of controlled thermal expansion, tensile and stress rupture properties, corrosion resistance, and elevated temperature oxidation resistance. Moreover, the alloy can be prepared, worked, and heat treated using well-known techniques and does not require a protective coating when exposed to operating temperatures up to 1200 F. or higher.

The terms and expressions which have been employed are used as terms of description and not of limitation. There is no intention in the use of such terms and expressions of excluding any equivalents of the features shown and described or portions thereof. It is recognized, however, that various modifications are possible within the scope of the invention claimed.

What is claimed is:

1. A precipitation strengthenable, nickel-cobalt-iron base alloy consisting essentially of, in weight percent, about Carbon 0.2 max.
Manganese 1 max.
Silicon 0.1–0.8
Phosphorus 0.015 max.
Sulfur 0.010 max.
Chromium 2.0–10
Nickel 15–29
Molybdenum 3 max.
Cobalt 24–46
Titanium 0.3–2
Aluminum 1 max.
Niobium 3–7
Vanadium 0.5 max.
Zirconium 0.1 max.
Boron 0.02 max.
Copper 0.5 max.
Tungsten 0.5 max.

and the balance is essentially iron, wherein a)

$$0.3 \leqq \frac{\%\ Ni - 1.4(\%\ Nb) - 4.8(\%\ Al) - 2.7(\%\ Ti)}{\%\ Co - 0.3(\%\ Nb) - 1.1(\%\ Al) - 0.6(\%\ Ti)} \leqq 1.3;$$

b)

$$47 \leqq \frac{[\%\ Ni + \%\ Co - 1.7(\%\ Nb) - 5.9(\%\ Al) - 3.3(\%\ Ti)] \times 100}{\%\ Ni + \%\ Co + \%\ Cr + \%\ Fe - 1.81(\%\ Nb) - 6.28(\%\ Al) - 3.52(\%\ Ti)} \leqq 53;$$

c) the combined amount of niobium, titanium, and aluminum is about 3–7 atomic percent of the alloy;

d) niobium, titanium, and aluminum are proportioned such that the ratio %Nb:%Ti=3:1 to 8:1 and the ratio %Ti:%Al≧1:1; and e) molybdenum and chromium are proportioned such that the ratio %Mo:%Cr≦1:2.

2. An alloy as set forth in claim 1 containing about 0.5% max. molybdenum and wherein %Mn+%Mo+%V+%Cu+%W≦2.

3. An alloy as set forth in claim 1 containing not more than about 8.0% chromium.

4. An alloy as set forth in claim 3 containing at least about 2.5% chromium.

5. An alloy as set forth in claim 1 wherein $$\frac{\%\ Ni - 1.4(\%\ Nb) - 4.8(\%\ Al) - 2.7(\%\ Ti)}{\%\ Co - 0.3(\%\ Nb) - 1.1(\%\ Al) - 0.6(\%\ Ti)} \leqq 1.2; \text{ and}$$

$$\frac{[\%\ Ni + \%\ Co - 1.7(\%\ Nb) - 5.9(\%\ Al) - 3.3(\%\ Ti)] \times 100}{\%\ Ni + \%\ Co + \%\ Cr + \%\ Fe - 1.81(\%\ Nb) - 6.28(\%\ Al) - 3.52(\%\ Ti)} \leqq 52.$$

6. An alloy as set forth in claim 1 wherein niobium, titanium, and aluminum are proportioned such that the ratio %Nb:%Ti=4:1 to 8:1 and the ratio %Ti:%Al=1:1 to 4:1.

7. A precipitation strengthenable, nickel-cobalt-iron base alloy consisting essentially of, in weight percent, about Carbon 0.1 max.
Manganese 0.5 max.
Silicon 0.15–0.6
Phosphorus 0.010 max.
Sulfur 0.010 max.
Chromium 2.5–8.0
Nickel 18–28
Molybdenum 0.5 max.
Cobalt 26–40
Titanium 0.4–1.8
Aluminum 0.1–0.9
Niobium 3.5–6.5
Vanadium 0.5 max.
Zirconium 0.1 max.
Boron 0.002–0.02
Copper 0.5 max.
Tungsten 0.5 max.

and the balance is essentially iron, wherein a)

$$0.3 \leqq \frac{\%\,Ni - 1.4(\%\,Nb) - 4.8(\%\,Al) - 2.7(\%\,Ti)}{\%\,Co - 0.3(\%\,Nb) - 1.1(\%\,Al) - 0.6(\%\,Ti)} \leqq 1.2;$$

b)

$$47 \leqq \frac{[\%\,Ni + \%\,Co - 1.7(\%\,Nb) - 5.9(\%\,Al) - 3.3(\%\,Ti)] \times 100}{\%\,Ni + \%\,Co + \%\,Cr + \%\,Fe - 1.81(\%\,Nb) - 6.28(\%\,Al) - 3.52(\%\,Ti)} \leqq 53;$$

c) the combined amount of niobium, titanium, and aluminum is about 3–7 atomic percent of the alloy;

d) niobium, titanium, and aluminum are proportioned such that the ratio %Nb:%Ti=3:1 to 8:1 and the ratio %Ti:%Al≧1:1; and e) %Mn+%Mo+%V+%Cu+%W≦2.

8. An alloy as set forth in claim 7 containing at least about 3.0% chromium.

9. An alloy as set forth in claim 8 containing not more than about 7.5% chromium.

10. An alloy as set forth in claim 7 wherein $$\frac{\%\,Ni - 1.4(\%\,Nb) - 4.8(\%\,Al) - 2.7(\%\,Ti)}{\%\,Co - 0.3(\%\,Nb) - 1.1(\%\,Al) - 0.6(\%\,Ti)} \leqq 1.0; \text{ and}$$

$$\frac{[\%\,Ni + \%\,Co - 1.7(\%\,Nb) - 5.9(\%\,Al) - 3.3(\%\,Ti)] \times 100}{\%\,Ni + \%\,Co + \%\,Cr + \%\,Fe - 1.81(\%\,Nb) - 6.28(\%\,Al) - 3.52(\%\,Ti)} \leqq 52$$

11. An alloy as set forth in claim 7 wherein niobium, titanium, and aluminum are proportioned such that the ratio %Nb:%Ti=4:1 to 8:1 and the ratio %Ti:%Al=1:1 to 4:1.

12. A precipitation strengthenable, nickel-cobalt-iron base alloy consisting essentially of, in weight percent, about Carbon 0.05 max.
Manganese 0.2 max.
Silicon 0.2–0.55
Phosphorus 0.005 max.
Sulfur 0.005 max.
Chromium 3.0–7.5
Nickel 20–27
Molybdenum 0.2 max.
Cobalt 27–34
Titanium 0.5–1.5
Aluminum 0.2–0.8
Niobium 4.0–6.0
Vanadium 0.2 max.
Zirconium 0.05 max.
Boron 0.003–0.01
Copper 0.2 max.
Tungsten 0.2 max.

and the balance is essentially iron, wherein a)

$$0.4 \leqq \frac{\%\,Ni - 1.4(\%\,Nb) - 4.8(\%\,Al) - 2.7(\%\,Ti)}{\%\,Co - 0.3(\%\,Nb) - 1.1(\%\,Al) - 0.6(\%\,Ti)} \leqq 1.0;$$

b)

$$47 \leqq \frac{[\%\,Ni + \%\,Co - 1.7(\%\,Nb) - 5.9(\%\,Al) - 3.3(\%\,Ti)] \times 100}{\%\,Ni + \%\,Co + \%\,Cr + \%\,Fe - 1.81(\%\,Nb) - 6.28(\%\,Al) - 3.52(\%\,Ti)} \leqq 52;$$

c) the combined amount of niobium, titanium, and aluminum is about 4–6atomic percent of the alloy;

d) niobium, titanium, and aluminum are proportioned such that the ratio %Nb:%Ti=4:1 to 8:1 and the ratio %Ti:%Al=1:1 to 4:1: and e) %Mn+%Mo+%V=%Cu+%W≦1.

13. An article formed of a precipitation strengthenable, nickel-cobalt-iron base alloy consisting essentially of, in weight percent, about Carbon 0.2 max.
Manganese 1 max.
Silicon 0.1–0.8
Phosphorus 0.015 max.
Sulfur 0.010 max.
Chromium 2.0–10
Nickel 15–29
Molybdenum 3 max.
Cobalt 24–46
Titanium 0.3–2
Aluminum 1 max.
Niobium 3–7
Vanadium 0.5 max.
Zirconium 0.1 max.
Boron 0.02 max.
Copper 0.5 max.
Tungsten 0.5 max.

and the balance is essentially iron, wherein a)

$$0.3 \leqq \frac{\%\,Ni - 1.4(\%\,Nb) - 4.8(\%\,Al) - 2.7(\%\,Ti)}{\%\,Co - 0.3(\%\,Nb) - 1.1(\%\,Al) - 0.6(\%\,Ti)} \leqq 1\,3.$$

b)

$$47 \leqq \frac{[\%\,Ni + \%\,Co - 1.7(\%\,Nb) - 5.9(\%\,Al) - 3.3(\%\,Ti)] \times 100}{\%\,Ni + \%\,Co + \%\,Cr + \%\,Fe - 1.81(\%\,Nb) - 6.28(\%\,Al) - 3.52(\%\,Ti)} \leqq 53;$$

c) the combined amount of niobium, titanium, and aluminum is about 3–7 atomic percent of the alloy;

d) niobium, titanium, and aluminum are proportioned such that the ratio %Nb:%Ti=3:1 to 8:1 and the ratio %Ti:%Al≧1:1; and e) molybdenum and chromium are proportioned such that the ratio %Mo:%Cr≦1:2.

14. An article as set forth in claim 13 wherein niobium, titanium, and aluminum are proportioned such that the ratio %Nb:%Ti=4:1 to 8:1 and the ratio %Ti:%Al=1:1 to 4:1.

* * * * *